US008567607B2

(12) United States Patent
Fischer

(10) Patent No.: US 8,567,607 B2
(45) Date of Patent: Oct. 29, 2013

(54) FOLDING BOX WITH A BLISTER PACK CONTAINED THEREIN

(75) Inventor: Michael Fischer, Waldshut-Tiengen (DE)

(73) Assignee: August Faller KG, Waldkirch (DE)

( * ) Notice: Subject to any disclaimer, the term of this patent is extended or adjusted under 35 U.S.C. 154(b) by 0 days.

(21) Appl. No.: 13/461,121

(22) Filed: May 1, 2012

(65) Prior Publication Data

US 2012/0279889 A1 Nov. 8, 2012

(30) Foreign Application Priority Data

May 3, 2011 (DE) ..... 10 2011 100 425

(51) Int. Cl.
*B65D 83/04* (2006.01)

(52) U.S. Cl.
USPC ..... 206/531; 206/1.5; 229/125.125

(58) Field of Classification Search
USPC ..... 206/1.5, 528, 530, 531, 534, 538, 539; 229/102, 125.125
See application file for complete search history.

(56) References Cited

U.S. PATENT DOCUMENTS

| | | | | |
|---|---|---|---|---|
| 6,491,211 | B1 * | 12/2002 | Evans et al. | 229/125.125 |
| 6,641,031 | B2 * | 11/2003 | Evans et al. | 229/102 |
| 7,637,375 | B2 * | 12/2009 | Sattel et al. | 206/531 |
| 7,658,287 | B2 * | 2/2010 | Hession | 206/528 |
| 8,011,512 | B2 * | 9/2011 | Brollier et al. | 206/531 |
| 2008/0217205 | A1 * | 9/2008 | Sattel et al. | 206/531 |
| 2009/0301924 | A1 * | 12/2009 | Rondeau | 206/531 |
| 2012/0234701 | A1 * | 9/2012 | Albrecht et al. | 206/1.5 |

FOREIGN PATENT DOCUMENTS

| | | |
|---|---|---|
| WO | 2005068304 | 7/2005 |

* cited by examiner

*Primary Examiner* — Luan K Bui
(74) *Attorney, Agent, or Firm* — Volpe and Koenig, P.C.

(57) ABSTRACT

A folding box with a blister pack held therein is produced from a one-piece blank, having a first tab which starts integrally from a narrow side wall and in the use position inside the folding box rises obliquely inwards from this edge toward the opposite wall and is supported resiliently against the latter. A second tab is bent back from the support point of the first tab and in the use position comes to lie between the first wall and the first tab or the second wall, and in turn carries at its edge a locking tab which in the use position engages in a hinged fashion between two blister cavities or cavity rows arranged one behind the other in the insertion direction, and thereby secures the blister pack in locking fashion without the need for beads or other deformations that affect the surface on the folding box.

13 Claims, 3 Drawing Sheets

FOLDING BOX WITH A BLISTER PACK CONTAINED THEREIN

CROSS-REFERENCE TO RELATED APPLICATIONS

This application claims the benefit of German Patent Application No. 10 2011 100 425.8, filed May 3, 2011, which is incorporated herein by reference as if fully set forth.

BACKGROUND

The invention relates to a folding box with a blister pack contained therein which can be removed on a narrow side and which in the use position bears against a first wall of the folding box with its underside or faces said wall, with at least one support for the blister pack inside the folding box, which in the use position engages in locking fashion between blister cavities arranged one behind the other in the direction of removal, being provided inside the folding box. The folding box has, on the inside at the opposite end to the end at which the blister pack is inserted and removed, a first hinged tab which extends inside the folding box in the opposite direction to the insertion direction of the blister pack and runs at least with its free end along that second wall of the folding box which in the use position is arranged above the cavities of the blister pack, more or less parallel to the latter and to the first wall, and, at the free end of this first tab, at least one second tab is arranged so that it can hinge counter to a restoring force and which in the use position engages in a hinged locking fashion between at least two blister cavities arranged one behind the other in the insertion and removal direction of the blister pack.

A comparable folding box with a blister pack contained therein is known from WO 2005/068304 A2. Here a tab engages inside the pack behind a special blister deformation, the purpose of which is not to hold products but simply as a blocking blister and which has a spacing from the product-containing blisters which is greater than the spacing between said blisters, so that there is sufficient room for the tab. The whole folding box and especially the blister pack too must therefore have considerably larger dimensions than are actually required for the packaged products.

Moreover, to remove the blister pack, care must be taken that the tab which engages at an acute angle in the opposite direction to the removal direction is removed from the engagement region.

SUMMARY

The object is therefore to provide a folding box with a blister pack contained therein of the type mentioned at the beginning, in which the blister pack can be fixed in locking fashion in the folding box but can also be pulled out again counter to an elastic resistance of the locking tab. This avoids the need to have to provide beads in the box or blocking blisters on the blister pack.

In order to achieve this object, the folding box defined at the beginning is characterized in that a third tab, which can hinge relative to the second tab, is arranged on that edge of the second tab which is remote from the first tab, and the bend lines or crease lines between the individual tabs run substantially parallel to one another, and in that in the use position the locking tab engages in the gap between at least two blister cavities arranged one behind the other in the removal direction and can be hinged relative to the second tab in opposite directions counter to the elasticity of the material as a result of it being displaced when the blister pack is inserted, on the one hand, and when it is withdrawn, on the other.

This arrangement avoids the need to have to apply beads or other deformations to the folding box itself or special blocking blisters, which are not used to hold packaged products, to the blister pack, in order to secure the blister pack. The tabs can in a simple fashion be already provided with the folding box and can be attached simply, and thus allow the folding box to be manufactured simply at virtually the same cost as for a folding box without a support for a blister pack.

To satisfactorily support the blister pack in the advantageously glued folding box, it is favorable if the second tab runs inwards at an acute angle to the blister pack from that edge of the first tab that bears against the second wall, and engages in a hinged locking fashion in the gap between at least two or more blister cavities arranged one behind the other in the removal direction. This gives an arrangement in which the first tab actually only needs to carry the second tab but at the same time also gives a certain elasticity to this second tab which can thus engage in locking fashion in a corresponding gap and the blister pack is thus secured but not prevented from being removed.

In the arrangement according to the invention, a first tab oriented counter to the insertion direction of the blister pack is, on the one hand, provided which carries a second tab bent back at an acute angle to it and on which the third tab which can hinge counter to the elasticity of the material then engages from above in the gap between the blister cavities and allows a hinging in opposite directions because of these multiple folds and crease lines so that it can be hinged first in the insertion direction, yielding to at least the first row of blister cavities, when the blister pack is pushed inside until a first spacing between such blister cavities comes within its range and it can hinge into it because of its elasticity. The blister pack is thereby secured in locking fashion but can also be pulled out again counter to the elastic resistance of this locking tab, wherein this locking tab can then be hinged in the opposite direction, namely in the removal direction of the blister pack, until the blister pack is freed. It is thus possible for this arrangement to be used with conventional blister-pack blisters holding packaged products.

It is particularly favorable in this arrangement that this locking tab can hinge in both directions counter to the elasticity of the material so that in its inserted position the blister pack cannot be blocked from being removed. It is accordingly sufficiently well secured, which can be determined by the choice of material and the choice of the residual spring effect between the individual tabs and in particular between the second tab and the locking tab, as well as by the dimensioning of the tabs relative to the blister pack.

For satisfactory operation, it is thus favorable if that part of the second tab which is situated higher relative to the blister cavities is arranged above these blister cavities in the use position and is folded back against the first tab at an acute angle, so that this second tab can serve to resiliently mount the third tab, i.e. the locking tab, but lies itself outside the range of the blister cavities. Although it may be conceivable to allow the second tab starting from the first tab also to engage resiliently in hinged fashion in the gap between the blister cavities on either side, so that the third tab would be dispensed with, trials have, however, shown that with such a folding box there is a risk that the blister pack becomes blocked in the pushed-in position or is insufficiently secured when the second tab can hinge too easily.

The crease line of the locking tab relative to the second tab can take the form of a groove and in particular partially of a score line or continuous slit.

In this way, it is possible to select in advance the degree to which the locking tab is resilient relative to the second tab, whilst at the same time allowing a hinging in both opposite directions.

The score line or slit can be arranged between two grooves arranged laterally to them and continuing them, and the length of the score line or the slit can correspond to approximately a third or approximately half or another fraction of the total length of the crease line. This can also depend on the width of the folding box, in other words the dimension in the direction of the fold lines or crease lines and can especially be chosen and determined on the basis of how strong the restoring force of the third tab is when it hinges in the two opposite directions, on the one hand, and how strong the force retaining it in the use position is, on the other hand.

It is particularly favorable for a satisfactory resilient and restoring effect if the first tab starts from that edge of the first box wall which is opposite the insertion end of the folding box and which faces the underside of the blister pack in the use position, if the first tab starting from this first box wall extends more or less obliquely to the opposite second wall situated above the cavities of the blister pack and bears elastically against it, and if the second tab extending from the second box wall is arranged at an acute angle in the insertion direction of the blister pack. In this way, the first tab can be used for the desired resilient effect when locking the blister pack because it extends from that edge of the first box wall which is furthest removed from the insertion opening in the insertion direction to the second box wall, as a result of which it is elastically tensioned and is depressed somewhat by the second box wall. This also gives the desired resilient effect to the second tab which is bent back at an acute angle from its free edge, in order to engage either itself or preferably with its third tab in resilient and locking fashion between the cavities of a blister pack.

Improvements to the resilient forces and the fixing of the second tab which is bent back at an acute angle can be obtained if, in the region of the articulation on the first tab, the second tab has an extension, cut out from the first tab, which bears—elastically and with some pressure—against the second wall of the folding box, and if the first tab has a recess, corresponding to the cut-in extension, which is correspondingly offset rearward relative to the free end of the extension in the insertion direction. In this way, it is achieved that this extension of the second tab is practically supported on the second box wall and this support extends somewhat over the crease line, by means of which the second tab engages with the first tab, so that the axis of hinging of the second tab with respect to the point at which it bears against the second box wall is offset rearward somewhat. Trials have shown that in this way the first and second tabs bear satisfactorily against the second wall of the folding box and that this bearing contact itself, because it is the extension of the second tab which comprises just one layer, entails virtually no risk when the blister pack is pushed in, that namely this blister pack might strike against this tab. There are two layers to a certain extent only in the somewhat rearward offset region in which the second tab has its axis of hinging on the first tab. The recess on the first tab and the extension of the second tab formed by the first tab therefore not only create a satisfactory hinged mounting of the second tab but also makes it easier to push in the blister pack when the latter is possibly in contact with the tab bearing against the second box wall, because in the case of this first contact the tab consists of just one layer and the second layer formed by the first tab only begins offset somewhat rearward in the insertion direction.

The crease line between the first and the second tab can be interrupted by the recess and the extension of the second tab. In practice, the second tab can therefore be hinged and crease only at those regions of the first tab which are situated to the sides of the recess of the first tab.

The groove at the crease point between the first and the second tab can be arranged on the side toward which it can hinge when the blister pack is removed. Accordingly it can be bent back satisfactorily relative to the first tab at an acute angle and be held in this position by the creasing process.

The dimensions of the recess on the first tab and hence the width of the extension of the second tab can correspond to approximately a third up to approximately half or also another fraction of the total width of the tabs which in particular all have the same width. Consequently, the force retaining the tabs in their use positions can also be largely predetermined.

It may be favorable especially when the folding box is finally folded if the first tab and the second tab starting from it in particular with the locking tab have a smaller width than the box wall from which it starts, and preferably therefore the first box wall. This makes it possible for the tabs to be deformed easily into the inside of the folding box when the folding box itself is folded and glued with its individual sections and regions.

The individual tabs are advantageously integrally connected to one another and the first tab can preferably also be integrally connected to the wall of the folding box from which it starts.

It is particularly favorable if the whole blank for the folding box has the first wall and the second wall of the box as well as connections between them and the first tab to the other tabs all in one piece, in other words practically the whole blank for the folding box with all the tabs is formed from a single blank. Thus only the usual gluing points which are present for folding boxes are required to complete the assembly, while in particular the tabs according to the invention are created when the blank for the folding box is produced and need only be bent, folded and/or creased into their use position. Special beads or other deformations which interfere with folding boxes can be avoided and a blister pack nevertheless held in place in locking fashion.

BRIEF DESCRIPTION OF THE DRAWINGS

An exemplary embodiment of the invention is described in detail below with the aid of drawings in which, in partially schematic views.

DETAILED DESCRIPTION OF THE PREFERRED EMBODIMENTS

Figure 1:
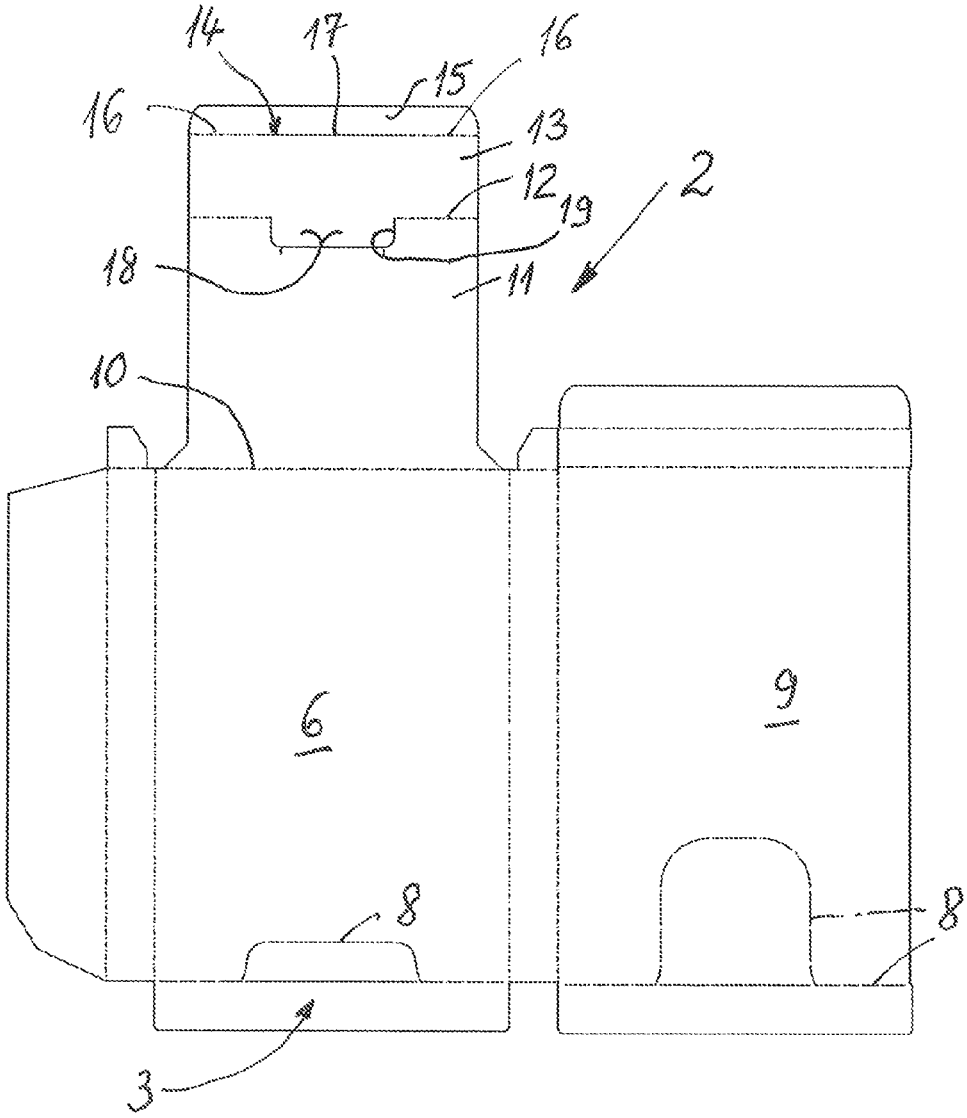
FIG. 1 shows a blank of a folding box that has not yet been folded and not yet been glued, with the normal sections for forming a closed rectangular folding box, wherein a tab, which in turn is integral with a second and a third tab, is arranged on the edge of one of the wide walls and initially continues it.

It should first be said that, in the longitudinal sections according to FIGS. 4 to 8, for the sake of greater clarity the cross-sectional thickness of the individual areas and tabs of the folding box which is usually made of cardboard have been shown with greater than normal dimensions.

A flat folding box which has been given the general reference numeral 1 and is rectangular in the exemplary embodiment is formed and glued in an intrinsically customary fashion from a one-piece blank which has been given the general reference numeral 2. This folding box 1 serves to store and protect a blister pack 4 which can be removed from a narrow side 3.

Figure 3:
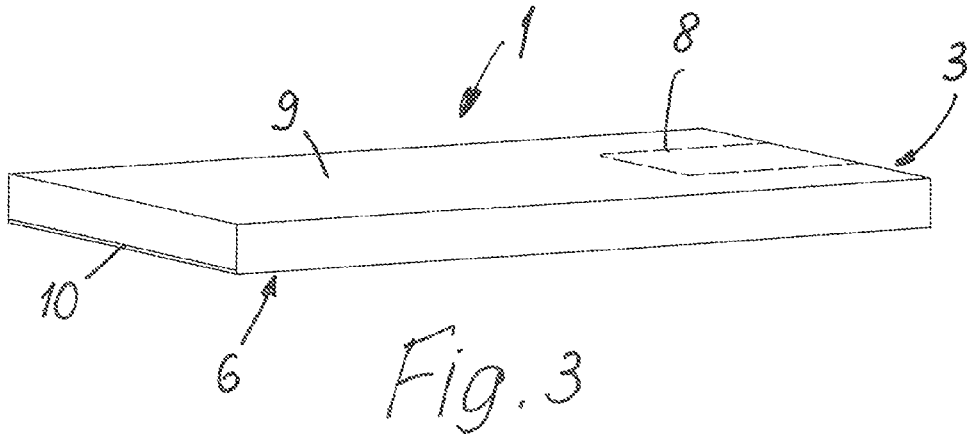
FIG. 3 shows a diagrammatic view of the outside of the fully folded folding box which serves to hold a blister pack.
Figure 4:
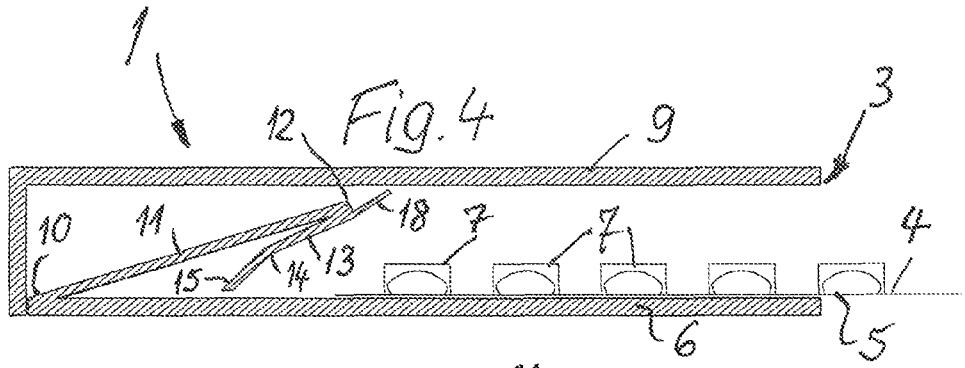
FIG. 4 shows a longitudinal section of the folding box according to the invention, through the two wide walls and the tab starting from the first wall, wherein a blister pack has been partially pushed into the folding box from an insertion opening of this folding box.

In the fully glued folding box 1 (compare FIGS. 3 to 8) this blister pack 4 bears with its underside 5 against a first wall 6 of this folding box 1 or its underside 5 faces this first wall 6 and, when the folding box 1 is stored flat according to FIG. 3, thus rests against this first wall which is the lower wall 6 in this position.

A support for this blister pack 4 inside the folding box 1, which in the use position engages in a manner still to be described in locking fashion between blister cavities 7 arranged one behind the other in the removal direction, is provided inside the folding box 1 so that the blister pack 4 cannot slip out of the folding box 1 even when the narrow side 3 is designed as an open removal opening as in FIGS. 4 to 8.

The narrow side 3 according to the blank in FIG. 1 and according to FIG. 3 can thus initially still be closed but can be opened permanently via preperforated lines 8 on the narrow side 3 so that the blister pack 4 can be repeatedly removed and put back in. The lines 8 are here formed according to FIG. 1 in such a way that they create, on the first wall 6 of the folding box 1 and especially also on the second wall 9 opposite the first wall 6, a correspondingly large cutout so that the blister pack 4 can be gripped.

Figure 2:
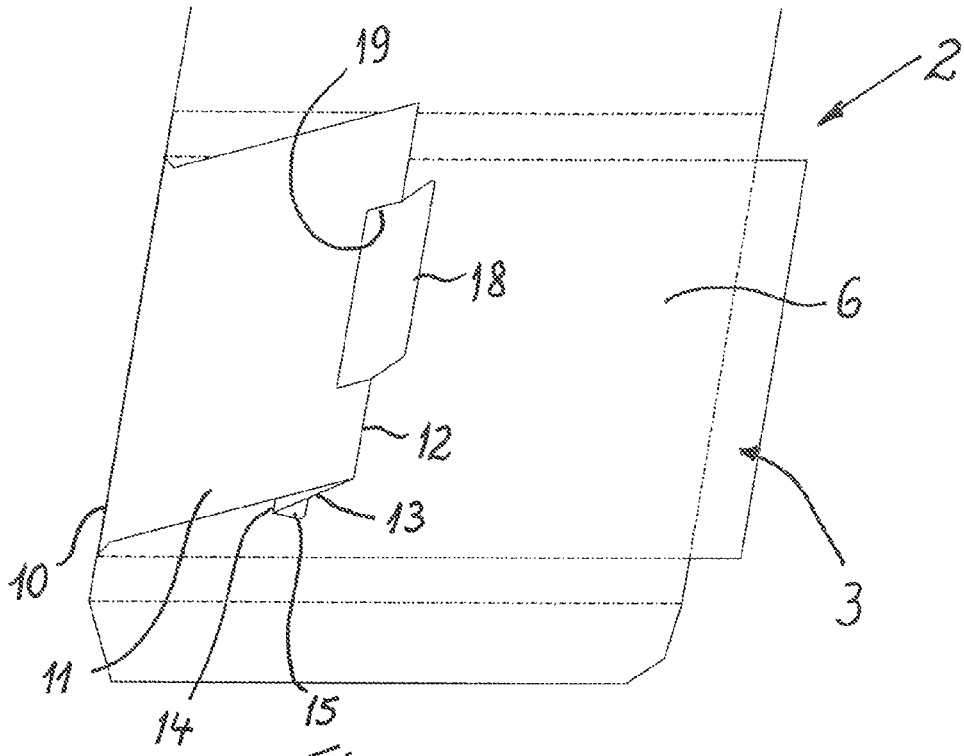
FIG. 2 shows a diagrammatic view of part of the blank shown in FIG. 1, after the first tab and also the second and the third tabs have been deformed into their use position relative to the first wall of this folding box, wherein the other areas of the blank have not yet been folded and have been shown only partially.

The abovementioned support for the blister pack 4 inside the folding box 1 is thus formed by the folding box 1 according to FIGS. 4 to 8 and also according to FIG. 2 having on the inside a first hinged tab 11 at the end remote from the insertion and removal end at the open narrow side 3 and at the edge 10 situated there of the first box wall 6, said hinged tab 11 extending inside the folding box 1 over a relatively small part of the extent of the folding box counter to the insertion direction of the blister pack 4 and extending with its free end 12 along that second wall 9 of the folding box 1 which in the use position is arranged above the cavities 7 of the blister pack 4 more or less parallel to the latter and to the first wall 6.

A second tab 13, which in the use position engages in a hinged locking fashion directly or (as in the exemplary embodiment) indirectly between at least two blister cavities 7 arranged one behind the other in the insertion and removal direction of the blister pack 4, is arranged so that it can hinge counter to a restoring force at the free end 12 of the first tab 11, which end 12 has a particular design which is still to be described below.

Figure 5:
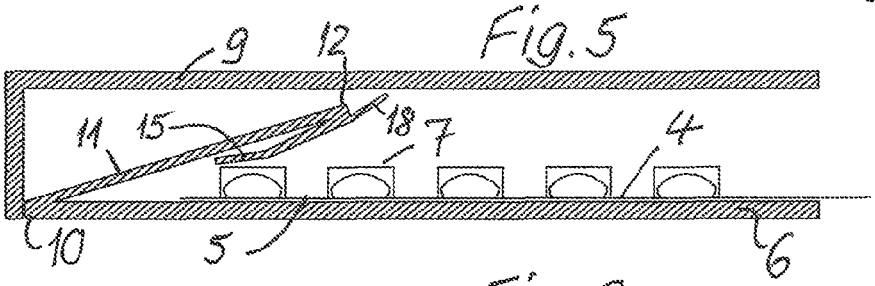
FIG. 5 shows a view corresponding to FIG. 4, wherein the blister pack is pushed in so far that it has deformed the third tab, i.e. the locking tab, in the insertion direction, which third tab rests on the first row of blister cavities.
Figure 6:
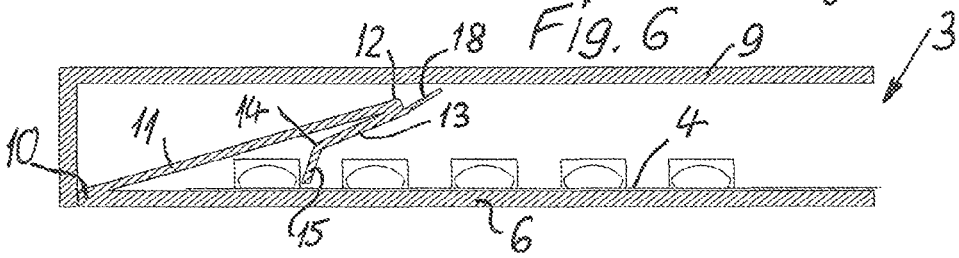
FIG. 6 shows a view corresponding to FIGS. 4 and 5, wherein the blister pack has been pushed further in so that the third tab or locking tab has, because of its elasticity, automatically bent back or dropped down into the gap between two rows of cavities of the blister pack situated one behind the other in the insertion direction, and the blister pack is thus secured in locking fashion in the folding box.

It can thus be seen from FIGS. 2 and 4 to 8 that this second tab 13 runs especially also in the insertion direction of this blister pack 4 from that edge or end 12 of the first tab 11 which bears against the second wall 9, at an acute angle to the blister pack 4, and engages in a hinged locking fashion which is still to be described in the gap between at least two or more blister cavities 7 according to FIG. 6 arranged one behind the other in the removal direction, when the blister pack 4 is in its stored position in the folding box 1.

It can thus be seen in both FIGS. 1 and 2 and FIGS. 4 to 8 that a third tab 15 which can hinge relative to the second tab 13 is arranged as a locking tab at that edge 14 of the second tab 13 which is remote from the first tab 11. It may also be said that the second tab 13 has two sections, the outermost section of which engages in locking fashion as a third tab 15 according to FIG. 6 between two blister cavities 7.

Figure 7:
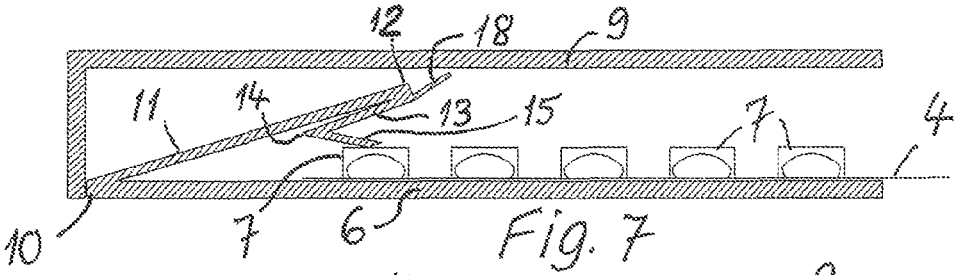
FIG. 7 shows a view corresponding to FIGS. 4 to 6, wherein the blister pack is pulled backward a little in the removal direction in order to remove it, as a result of which the last row of blister cavities in the removal direction, i.e. the front row of blister cavities when the blister pack is inserted, has hinged the third tab which rests resiliently against these blister cavities, in the removal direction.
Figure 8:
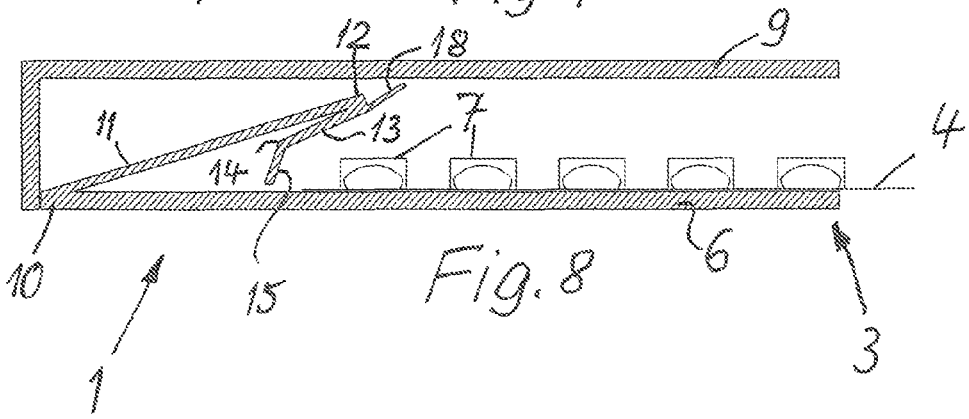
FIG. 8 shows a view corresponding to FIGS. 4 to 7, after the blister pack has been pulled backward from the position shown in FIG. 7 further in the removal direction, as a result of which the blister cavities have moved out of the range of the tabs and in particular the third or locking tab.

The bend lines or crease lines between the individual tabs 11, 13 and 14 thus run according to FIGS. 1 and 2 parallel to one another and to the edge 10. Only the locking tab 15, i.e. that outer part of the second tab 13 which forms the locking tab 15, engages in the use position in locking fashion in the gap between at least two blister cavities 7 arranged one behind the other in the removal direction, and can hinge relative to the second tab 13 in opposite directions counter to the elasticity of the material as a result of it being displaced when the blister pack 4 is inserted (FIGS. 4 to 6), on the one hand, and when it is pulled out (FIGS. 6 to 8), on the other hand, which is especially very clear if FIGS. 5 and 7 are compared, where this locking tab 15 is hinged in completely opposing directions because it is respectively struck by a blister cavity 7.

That part of the second tab 13 which is situated higher with respect to the blister cavities 7, in other words the second tab 13 situated between the edges 12 and 14, is according to FIGS. 4 to 8 arranged in the use position above the blister cavities 7 and, as already mentioned, folded back at an acute angle with respect to the first tab 11, while at its edge 14 it carries the locking tab 15 which can be hinged to both sides counter to the elasticity of the material.

It is indicated in FIG. 1 that the crease lines, and thus also the crease line 14 of the locking tab 15 relative to the second tab 13, are designed as a groove 16 and partially as a score line 17 or continuous slit, in order to achieve the desired elastic movability of the locking tab 15.

The score line 17 or the slit is thus arranged between two lateral grooves 16 which continue it, and the length of the score line 17 is approximately half the total length of the crease line 14.

Although the first tab 11 could start from the end of the second wall 9 of the folding box 1 with its free edge 12 and the second tab 13 bent back at an acute angle relative to the latter, in the exemplary embodiment it is provided that the first tab 12 starts from that edge 10 of the first box wall 6 which is remote from the insertion end at the open narrow side 3 of the folding box 1 and rises with respect to the first wall 6 obliquely to the opposite second wall 9 and bears elastically against it, which is not shown in the drawings for the sake of greater clarity so that all the parts and edges can be distinguished. As already mentioned, the second tab 13, starting from the second box wall 9, is formed and arranged at an acute angle in the insertion direction of the blister pack 4.

When it is pushed in under the first tab 11 (compare FIGS. 5 and 6), the blister pack is thus not obstructed but, because the two tabs 11 and 13 run obliquely, is guided in the last part of the insertion movement as if through an insertion funnel.

Another expedient and advantageous embodiment and development is shown in FIGS. 1, 2 and 4 to 8 which is provided in that the second tab 13 has, in the region of the articulation 12 on the first tab 11, an extension 18 which is cut out from the first tab 11, extends over a part of its width, and in the use position bears against the second wall 9 of the folding box and thus has just one layer, so allowing the blister pack 4 to be correspondingly pushed in unobstructed. The first tab 11 thus has a recess 19 which corresponds to the cut-in extension 18 and is offset rearward in the insertion direction relative to the end of the extension 18.

The tab 13 is even better resiliently supported against the box wall 9 by this extension 18 and can correspondingly be moved resiliently about the crease line or articulation 12 in particular when the blister pack 4 according to FIG. 5 engages the third tab or locking tab 13 which is carried along by it and correspondingly deforms said locking tab 13. Because of its spring effect, the extension 18 can contribute, according to FIG. 6, to the second tab 13 and thus especially also the locking tab 15 which belongs to it or is arranged on it being able to spring correspondingly well because of the restoring force into the gap between two blister cavities 7.

It is also clear especially with reference to FIGS. 1 and 2 that the crease line 14 between the first tab 11 and the second tab 13, which permits the mutual hinging of these tabs 11 and 12 relative to each other, is interrupted by the recess 19 and thus by the extension 18 of the second tab 13. The dimension of the cutout or recess 19 and hence the width of the extension 18 of the second tab 13 corresponds in the exemplary embodiment to approximately a third or a little more than a third of the total width of the tabs 11 and 13 which otherwise have the same width.

FIG. 1 in particular illustrates that the width of the first tab 11 and of the second tab 13 which starts from it or is suspended from it and has the locking tab 15 too is smaller than the width of the box wall 6, from which it starts. According to FIG. 2, it can correspondingly well be folded into the inside of the folding box 1 without obstructing the unfolding of the other surfaces and components and tabs of the folding box 1 when it is being completed.

In the same way as the whole folding box 1 with all its individual parts, the individual tabs are also integrally connected to one another, the first tab 11 being integrally connected to the wall 6 of the folding box 1, from which wall 6 it starts and with respect to which it is connected via a crease line running along the edge 10.

The folding box 1 with a blister pack 4 held inside it is produced from a one-piece blank 2. This blank 2 has a first tab 11 which starts from a narrow side of the wall 6 in an integral fashion and in the use position inside the folding box rises obliquely inwards from this edge 10 toward the opposite wall 9 and is supported resiliently against the latter. A second tab 13 is bent back in the opposite direction at an acute angle from the support point of the first tab and thus in the use position comes to lie between the first wall 6 and the first tab 11 or the second wall 9 and in turn has at its edge 14 a locking tab 15 which in the use position engages in a hinged fashion between two blister cavities 7 or rows of such blister cavities 7 arranged one behind the other in the insertion direction, and thereby secures the blister pack 4 in locking fashion without there being any need for beads or other deformations that affect the surface on the folding box 1.

The invention claimed is:

1. A folding box assembly comprising a folding box (1) with a blister pack (4) contained therein which can be removed on a narrow side (3) of the folding box and which in a use position bears against a first wall (6) of the folding box (1) with an underside (5) thereof or faces said first wall (6), at least one support for the blister pack (4) inside the folding box (1), which in the use position engages in locking fashion between blister cavities (7) arranged one behind another in a removal direction, being provided inside the folding box (1), the folding box (1) having, on an inside at an opposite end to an end at which the blister pack is inserted and removed, a first hinged tab (11) which extends inside the folding box (1) in an opposite direction to the insertion direction of the blister pack (4) and runs at least with a free end (12) thereof along a second wall (9) of the folding box (1) which in the use position is arranged above the cavities (7) of the blister pack (4), more or less parallel to the latter and to the first wall (6), and, at the free end (12) of the first tab (11), at least one second tab (13) is arranged that is hingeable counter to a restoring force and which in the use position engages in a hinged locking fashion between at least two of the blister cavities (7) arranged one behind the other in the insertion and removal direction of the blister pack (4), wherein a third tab (15), which is hingeable relative to the second tab (13), is arranged on an edge (14) of the second tab (13) which is remote from the first tab (11), and bend lines or crease lines between the individual tabs extend substantially parallel to one another, and in the use position the third tab (15) engages in the gap between the two blister cavities (7) arranged one behind the other in the removal direction and can be hinged relative to the second tab (13) in opposite directions counter to an elasticity of the material as a result of displacement upon the blister pack (4) being inserted, on the one hand, or withdrawn, on the other.

2. The folding box assembly of claim 1, wherein the second tab (13) extends inwards at an acute angle to the blister pack (4) from the free end (12) of the first tab (11) that bears against the second wall (9) and engages in a hinged locking fashion in the gap between at least two or more blister cavities (7) arranged one behind the other in the removal direction.

3. The folding box assembly of claim 1, wherein a part of the second tab (13) which is situated higher relative to the blister cavities (7) is arranged above the blister cavities (7) in the use position and is folded back against the first tab at an acute angle.

4. The folding box assembly of claim 1, wherein the crease line between the third tab (15) and the second tab (13) comprises at least one of a groove (16), a score line (17), and a continuous slit.

5. The folding box assembly of claim 4, wherein the score line (17) or the slit is arranged between two lateral grooves (16), and a length of the score line (17) or the slit corresponds to approximately a third or approximately half of a total length of the crease line.

6. The folding box assembly of claim 1, wherein the first tab (12) starts from the edge (10) of the first box wall (6) which is opposite the insertion end of the folding box (1) and which faces the underside of the blister pack in the use position, the first tab starting from the first box wall extends obliquely to the opposite second wall situated above the cavities of the blister pack and bears elastically against it, and the second tab (13) extending from the second box wall (9) is arranged at an acute angle in the insertion direction of the blister pack (4).

7. The folding box assembly of claim 1, wherein, in a region of articulation on the first tab (11), the second tab (13) has an extension (18), cut out from the first tab (11), which bears against the second wall (9) of the folding box, and the first tab (11) has a recess (19) corresponding to the extension (18), which is offset rearward relative to a end of the extension (18) in the insertion direction.

8. The folding box assembly of claim 7, wherein the crease line between the first tab (11) and the second tab (13) is interrupted by the recess (19) and the extension (18) of the second tab (13).

9. The folding box assembly of claim 8, wherein a groove at the crease line between the first and the second tab is arranged on a side toward which it can hinge when the blister pack is removed.

10. The folding box assembly of claim 7, wherein dimensions of the recess (19) and hence a width of the extension (18) of the second tab (13) correspond to approximately a third up to approximately half a total width of the tabs (11, 13) which all have a same width.

11. The folding box assembly of claim 10, wherein the width of the first tab (11) and of the second tab (13) starting from it with the third tab (15) is smaller than a width of the wall (6) of the box from which it starts.

12. The folding box assembly of claim 1, wherein the individual tabs are integrally connected to one another, and the first tab (11) is integrally connected to the wall of the folding box from which it starts.

13. The folding box assembly as claimed in claim 1, wherein a blank used to form the folding box has the first wall and the second wall of the box as well as connections between them and the first tab to the other tabs all in one piece.

* * * * *